US010121622B2

(12) United States Patent
Smith et al.

(10) Patent No.: US 10,121,622 B2
(45) Date of Patent: Nov. 6, 2018

(54) SYSTEMS AND METHODS FOR CONTROLLING RELAY ACTIVATION TIMING

(71) Applicant: Control4 Corporation, Salt Lake City, UT (US)

(72) Inventors: Gregory Scott Smith, Woods Cross, UT (US); Sidney Lyle King, North Logan, UT (US)

(73) Assignee: Control4 Corporation, Salt Lake City, UT (US)

( * ) Notice: Subject to any disclaimer, the term of this patent is extended or adjusted under 35 U.S.C. 154(b) by 284 days.

(21) Appl. No.: 15/018,679

(22) Filed: Feb. 8, 2016

(65) Prior Publication Data

US 2017/0229269 A1 Aug. 10, 2017

(51) Int. Cl.
*H01H 47/00* (2006.01)
*H01H 47/20* (2006.01)

(52) U.S. Cl.
CPC ..... *H01H 47/20* (2013.01); *H01H 47/002* (2013.01)

(58) Field of Classification Search
CPC ..... H01H 47/20
See application file for complete search history.

(56) References Cited

U.S. PATENT DOCUMENTS 6,566,882 B2 * 5/2003 Baldwin ..... G01R 31/3278 324/418
8,000,933 B1 * 8/2011 Poeltl ..... H01H 47/002 307/126
8,154,841 B2 * 4/2012 Allen ..... H01H 9/56 361/139

* cited by examiner

*Primary Examiner* — Stephen W Jackson
(74) *Attorney, Agent, or Firm* — Austin Rapp

(57) ABSTRACT

Circuitry for controlling relay activation timing is described. The circuitry includes voltage zero cross detection circuitry configured to produce a zero cross detection signal indicating a zero cross time of an alternating current (AC) signal. The circuitry also includes current measuring circuitry coupled to voltage zero cross detection circuitry. The current measuring circuitry is configured to produce a current flow detection signal indicating a current flow start time of the AC signal. The circuitry further includes relay circuitry coupled to the current measuring circuitry. The circuitry additionally includes a processor coupled to the voltage zero cross detection circuitry, to the current measuring circuitry, and to the relay circuitry. The processor is configured to determine a relay time error based on the zero cross time and the current flow start time. The processor is also configured to control relay activation signal timing to reduce the relay time error.

18 Claims, 6 Drawing Sheets

400

SYSTEMS AND METHODS FOR CONTROLLING RELAY ACTIVATION TIMING

TECHNICAL FIELD

The present disclosure relates generally to electrical devices, and more particularly, to systems and methods for controlling relay activation timing.

BACKGROUND

A wide variety of electrical devices are commonly manufactured and used. For example, many electrical devices are routinely used to perform a variety of tasks. Such devices may range in function from simple on/off switches that simply open and close circuits, to complicated devices capable of computing complex problems or transmitting wireless commands for home automation or the like. Some examples of electrical devices may include circuitry, integrated circuits, lights, appliances, computers, game systems, televisions, sound systems, security systems, window coverings, heating and cooling equipment, and the like.

Electrical devices may include a variety of components. Examples of components may include resistors, transistors, capacitors, inductors, transformers, etc. The components may function and/or affect electrical charges and/or signals differently.

In some cases, one or more components may degrade (e.g., wear out) and/or fail due to use. Accordingly, it may be beneficial to avoid and/or reduce component degradation and/or failure.

SUMMARY

Circuitry for controlling relay activation timing is described. The circuitry includes voltage zero cross detection circuitry configured to produce a zero cross detection signal indicating a zero cross time of an alternating current (AC) signal. The circuitry also includes current measuring circuitry coupled to voltage zero cross detection circuitry. The current measuring circuitry is configured to produce a current flow detection signal indicating a current flow start time of the AC signal. The circuitry further includes relay circuitry coupled to the current measuring circuitry. The circuitry additionally includes a processor coupled to the voltage zero cross detection circuitry, to the current measuring circuitry, and to the relay circuitry. The processor is configured to determine a relay time error based on the zero cross time and the current flow start time. The processor is also configured to control relay activation signal timing to reduce the relay time error.

The processor may be configured to determine the relay time error as a time difference between the current flow start time and the zero cross time. The processor may be configured to adjust the activation signal timing by increasing or decreasing a timing delay by an amount of the relay time error.

The processor may be configured to activate the relay based on adjusted relay activation signal timing for a next switching cycle. The processor may be configured to start utilizing the current flow detection signal upon detection of a relay activation instruction.

The processor may be configured to determine whether the current flow detection signal is greater than a current threshold. The processor may be configured to determine the current flow start time by stepping back from a time at which the current flow detection signal crossed the current threshold.

The current measuring circuitry may be coupled between an alternating current supply and an input to the relay circuitry. The voltage zero cross circuitry may be coupled between an alternating current supply and the processor.

A method for controlling relay activation timing is also described. The method includes producing a zero cross detection signal indicating a zero cross time of an alternating current (AC) signal. The method also includes producing a current flow detection signal indicating a current flow start time of the AC signal. The method further includes determining a relay time error based on the zero cross time and the current flow start time. The method additionally includes controlling relay activation signal timing to reduce the relay time error.

A non-transitory tangible computer-readable medium for controlling relay activation timing is also described. The computer-readable medium includes executable instructions for determining a relay time error based on a zero cross time and a current flow start time. The computer-readable medium also includes executable instructions for controlling relay activation signal timing to reduce the relay time error.

DETAILED DESCRIPTION

Figure 1:
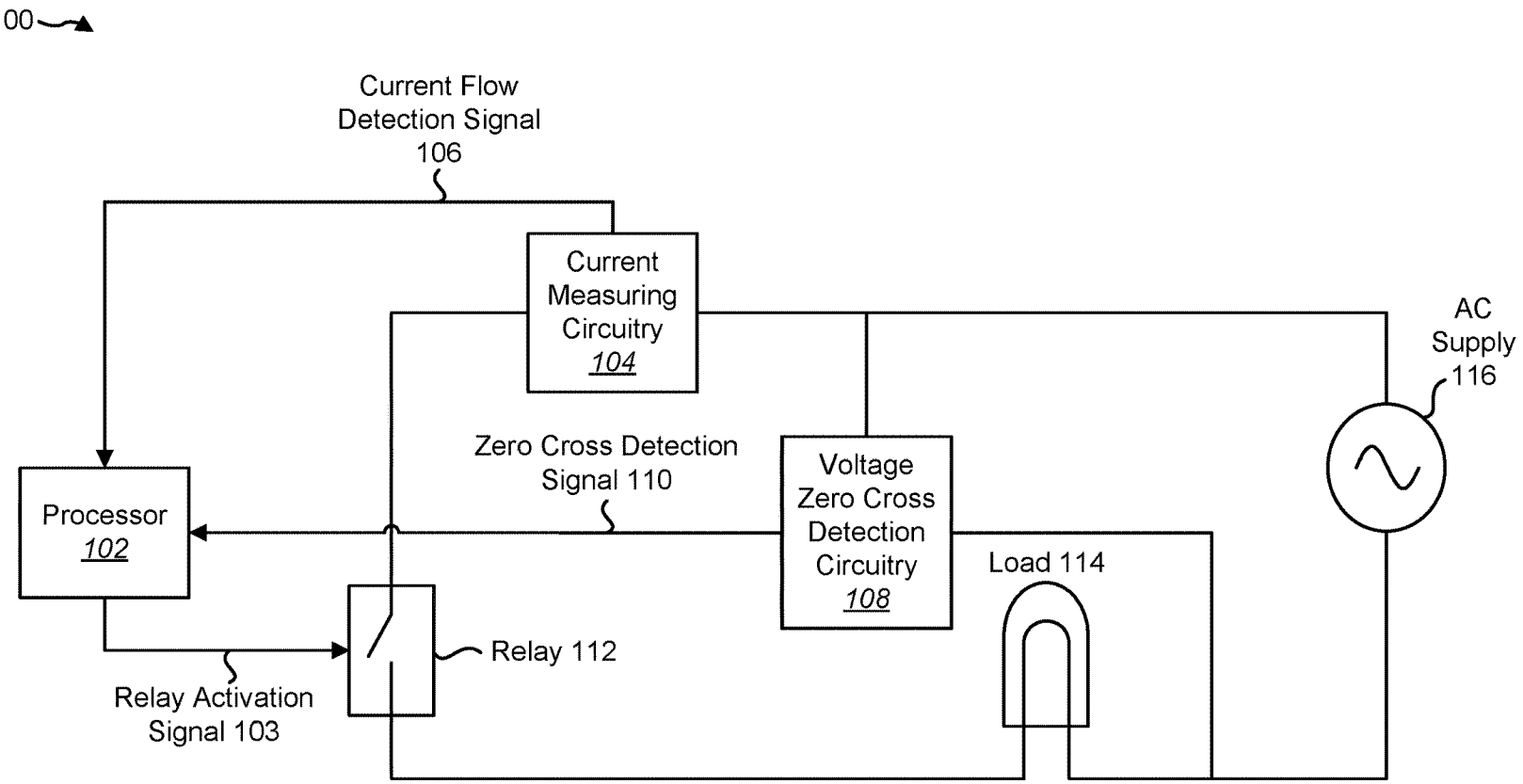
FIG. 1 is a block diagram illustrating one configuration of circuitry in which systems and methods for controlling relay activation timing may be implemented.

The systems and methods disclosed herein may relate to adjusting relay activation based on when current starts flowing. For example, switches that use relays in an alternating current environment may increase relay life by turning on when the incoming line voltage is at a minimum, commonly called voltage zero cross. However, a delay exists from when the relay receives the activation signal before its contacts actually close. To account for this delay, the switch hardware may send the relay activation signal prior to line voltage zero cross. However, this delay may vary from relay to relay and/or may change as the relay ages. Such delay variations may expose the relay's contacts to unwanted damaging energy (e.g., arcing). This problem may be addressed by utilizing additional sensing circuitry to compensate for timing variations, additional protection circuitry and/or physically larger relays capable of enduring the destructive energy.

Some approaches to addressing the problem may include estimating a static average activation time of a relay and using that estimate as activation time delay compensation. Any unpredicted variations in the relay may be accepted in this approach. According to that approach, a larger more robust relay and/or snubber circuitry may be utilized. Another approach may utilize load voltage sense circuitry on the relay's load output to sense when the contacts closed to actively alter the timing to compensate for delay variations.

Some configurations of the systems and methods disclosed herein may include actively compensating for delay variations without the need of load voltage sense circuitry. For example, some configurations may utilize voltage zero cross detection circuitry (e.g., one line voltage zero cross detector) and current measuring circuitry (e.g., current sense detection circuitry). In some approaches, the current measuring circuitry (e.g., current sense detection circuitry) may be similar to and/or may include circuitry used for fault protection on the relay's output.

Some configurations of the systems and methods disclosed herein may utilize the time when current starts flowing to indicate relay contact closure. A processor (e.g., central processing unit (CPU) may measure the time from when the turn on signal is sent until current flow is indicated by the current measuring circuitry. The processor (e.g., CPU) may use the activation signal as a starting reference, may compare the time that current started flowing to the time when the line voltage zero cross occurred. This time difference may be and/or may approximate the relay time error (e.g., relay activation time error, relay activation time delay, etc.). The processor (e.g., CPU) may adjust the activation signal for the next switching cycle until zero cross and current flow occur at the same time.

Some benefits of the systems and methods disclosed herein (e.g., actively compensating for relay delay based on current flow) may include is lengthened relay life and/or space savings. For example, the systems and methods disclosed herein may allow relays to be smaller and may require less space (e.g., minimal space) for the detection circuitry. For instance, fault protection sensing circuitry that is already in place may be utilized to also control relay activation timing.

Various configurations are now described with reference to the Figures, where like reference numbers may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

FIG. 1 is a block diagram illustrating one configuration of circuitry 100 in which systems and methods for controlling relay activation timing may be implemented. It should be noted that the circuitry 100 may be implemented in a variety of electrical devices. Examples of electrical devices that may be implemented with the circuitry 100 may include switches, power outlets, lights, light fixtures, appliances (e.g., clothes washers, clothes dryers, dishwashers, refrigerators, ovens, toasters, etc.), televisions, entertainment systems, sound systems (e.g., stereos), game consoles, computers, computing devices, security systems, home automation systems, etc. Additionally or alternatively, the circuitry 100 may be coupled to one or more loads 114. Examples of loads 114 include switches, power outlets, lights, light fixtures, appliances (e.g., clothes washers, clothes dryers, dishwashers, refrigerators, ovens, toasters, etc.), televisions, entertainment systems, sound systems (e.g., stereos), game consoles, computers, computing devices, security systems, home automation systems, etc.

The circuitry 100 may include a processor 102 (e.g., a CPU), current measuring circuitry 104, voltage zero cross detection circuitry 108 and/or a relay 112. The circuitry 100 may include and/or be coupled to a load 114 and/or an alternating current (AC) supply 116. For example, the circuitry 100 may be coupled to AC mains electricity (e.g., a power outlet) and/or another AC supply. It should be noted that the circuitry 100 may or may not include the load 114 and/or AC supply 116. As used herein, the term "couple" and variations thereof may denote a direct or indirect connection. For example, if a first component is coupled to a second component, the first component may be directly connected to the second component (without any intervening components, for instance) or may be indirectly connected to the second component (via one or more intervening components, for instance). Components may be electrically coupled to and/or connected to each other via one or more conductors (e.g., wires). A line between components in block diagrams given in one or more of the Figures may indicate a coupling.

The voltage zero cross detection circuitry 108 may be configured to produce a zero cross detection signal 110. The zero cross detection signal 110 may indicate a zero cross time of an AC signal. For example, the voltage zero cross detection circuitry 108 may be coupled to the AC supply 116 (e.g., between the AC supply 116 line and neutral). For instance, the AC supply 116 may provide an AC source to the line (e.g., hot), and the neutral may provide a return path to the AC supply 116. The AC supply 116 may provide an AC signal. As the AC signal oscillates between positive and negative charge, the voltage zero cross detection circuitry 108 may produce a zero cross detection signal 110, which may indicate one or more zero cross times when the AC signal is at approximately zero charge.

In some configurations, the voltage zero cross detection circuitry 108 may be digital circuitry that outputs a digital signal. For example, the zero cross detection signal 110 may be a digital signal. In some implementations, the zero cross detection signal 110 may provide a digital indicator (e.g., step signal, pulse, etc.) that indicates when a zero cross in the AC signal has occurred. In some implementations, the zero cross detection signal 110 may provide digital samples (e.g., bits, numbers, etc.) that represent AC signal voltage sample amplitudes. This may indicate a zero crossing to the processor 102, since the processor 102 may observe when a positive sample switches to a negative sample and/or when a zero sample occurs. Additionally or alternatively, the zero cross detection signal 110 may provide digital time indicators (e.g., bits, numbers, etc.) that record a time when a zero cross has occurred. For example, the zero cross detection signal 110 may include a series of timestamps of zero cross times.

In some configurations, the voltage zero cross detection circuitry 108 may be analog circuitry that outputs an analog signal. For example, the zero cross detection signal 110 may be an analog signal. In some implementations, the zero cross detection signal 110 may provide an analog indicator (e.g., waveform, etc.) that indicates when a zero cross in the AC signal has occurred. This may indicate a zero crossing to the processor 102, since the processor 102 may observe when the waveform switches from positive to negative or vice versa. In some implementations, the zero cross detection signal 110 may be and/or represent the real-time voltage waveform of the AC signal.

It should be noted that in some configurations, a voltage zero cross signal (e.g., AC signal voltage, zero cross detection signal 110, etc.) may be converted to a digital signal within or outside of the processor 102 (e.g., CPU). For example, the voltage zero cross detection circuitry 108 may convert the AC signal voltage to a digital signal (to produce the zero cross detection signal 110, for instance) or the processor 102 may convert the zero cross detection signal 110 to a digital signal. By analyzing the voltage values, the circuitry 100 may determine the one or more zero cross times. Analysis of the voltage values may be performed in (e.g., by) the processor 102 (e.g., CPU) or outside of the processor 102 (e.g., in the voltage zero cross detection circuitry 108).

The current measuring circuitry 104 may be configured to produce a current flow detection signal 106. The current flow detection signal 106 may indicate a current flow start time of an AC signal. For example, the current measuring circuitry 104 may be coupled to the AC supply 116 (e.g., between the AC supply 116 line and the relay 112 or between the relay and AC supply 116 neutral). For instance, the current measuring circuitry 104 may be coupled to the input of the relay 112 or to the output of the relay 112. When the relay 112 is activated (e.g., when the relay 112 contacts close), current supplied by the AC signal may start flowing through the relay 112 (to the load 114, for example). The current measuring circuitry 104 may produce a current flow detection signal 106, which may indicate one or more current flow start times, which may indicate when the current starts to flow through the relay 112. In some implementations, the current flow detection signal 106 may be and/or represent the real-time current waveform of the AC signal.

In some configurations, the current measuring circuitry 104 may be analog circuitry that outputs an analog signal. For example, the current flow detection signal 106 may be an analog signal. In some implementations, the current flow detection signal 106 may provide an analog indicator (e.g., waveform, etc.) that indicates when a current flow starts through the relay 112. This may indicate a current flow start time to the processor 102, since the processor 102 may observe when the current begins to flow. For example, the current flow detection signal 106 may indicate when the current is non-zero and/or not merely noise. The current flow start time may be the first time (since the activation instruction is detected, for example) that the current signal is non-zero or last time at which the current was zero before becoming non-zero, for instance. For example, the processor 102 may observe when a current (e.g., real-time current, rectified current, rectified average current, root-mean-square (RMS) current, etc.) is non-zero and/or not merely noise.

In some configurations, the current measuring circuitry 104 may be digital circuitry that outputs a digital signal. For example, the current flow detection signal 106 may be a digital signal. In some implementations, the current flow detection signal 106 may provide a digital indicator (e.g., step signal, pulse, etc.) that indicates when a current flow starts. In some implementations, the current flow detection signal 106 may provide digital samples (e.g., bits, numbers, etc.) that represent AC signal current sample amplitudes. This may indicate a current flow start time to the processor 102, since the processor 102 may observe when a current (e.g., real-time current, rectified current, rectified average current, RMS current, etc.) is non-zero and/or not merely noise. Additionally or alternatively, the current flow detection signal 106 may provide digital time indicators (e.g., bits, numbers, etc.) that record a time when a current flow start has occurred. For example, the current flow detection signal 106 may include one or more timestamps of one or more current flow start times.

In some configurations, the current measuring circuitry 104 may indicate whether a current (e.g., AC signal current) has reached a current threshold. For example, the current flow detection signal 106 (which may be an analog or digital signal as described above) may indicate whether the current has reached and/or crossed a current threshold. In some implementations, thresholding the current may be performed in order to filter signal noise (e.g., to avoid determining an erroneous current flow start time based on signal noise). Additionally or alternatively, threshold the current may be performed to avoid analyzing and/or adjusting relay activation signal timing for currents that would be unlikely to significantly degrade the relay 112. For example, the relay activation signal timing may not be adjusted if the current drawn by the load 114 is sufficiently small in some implementations. For instance, if the current drawn by the load 114 is sufficiently small, then the relay 112 may not be significantly damaged if the relay activation does not occur (approximately) at a zero cross time. Accordingly, the relay activation timing may be controlled by determining to not measure the relay time error and/or to not adjust relay activation timing in some configurations.

In some implementations, a threshold amount of current flow (e.g., AC signal current flow, current flow detection signal 106, etc.) may be detected by the circuitry 100 (e.g., by the current measuring circuitry 104 and/or by the processor 102, for example). When the current flow reaches the current threshold, the circuitry 100 (e.g., the current measuring circuitry 104 and/or the processor 102, for example) may look backward in time at the current flow measurements (e.g., analog current flow measurements) until a value within some tolerance of zero is found, which may indicate that current is beginning to flow at that point in time.

Some implementations of the systems and methods disclosed herein may include one or more of the following features. In particular, a current threshold may be utilized and/or spurious noise may be filtered out in some implementations as follows. The processor 102 (e.g., CPU) may monitor a real-time current waveform from the current measuring circuitry 104. For example, the current flow detection signal 106 may be a real-time current waveform in some implementations. When monitoring this current waveform, two conditions may be met before the processor 102 (e.g., CPU) acts on the signal in some implementations: the current waveform may exceed the current threshold and the current threshold may be exceeded for a duration of time (e.g., a trigger period). Noise may be filtered out either because the noise is not above the threshold and/or because the time above the threshold is not long enough to be considered.

Low pass filtering the current signal (e.g., AC current signal, current flow detection signal 106, etc.) may or may not be implemented. It should be noted that low pass filtering could result in the loss of accuracy if not implemented correctly. For example, when the contacts of the relay 112 engage, the initial current inrush to the load may jump with a high slew rate such that the current signal may include a large amount of high frequency content. The aggressive low pass filtering needed to filter out the noise may filter that high frequency content, although the resultant waveform may be distorted, which may cause the timing to be slightly off. A less aggressive low pass filter may work, but may need to be balanced between noise filtering and timing accuracy.

Averaging and/or taking the RMS of the current signal (e.g., AC signal current, current flow detection signal 106, etc.) may or may not be implemented. It should be noted that taking an average and/or RMS of the current signal may work if implemented correctly, but the average and/or RMS are measurements calculated over a time period, which may result in the loss of accuracy. Accordingly, while averaging or root mean squaring may work if implemented correctly, these approaches may not be utilized in some implementations. For example, real-time waveforms (e.g., real-time current signal and/or real-time voltage signal) may be utilized instead in some implementations.

It should be noted that in some configurations, current flow (e.g., AC signal current flow, current flow detection signal 106, etc.) may be converted to a digital signal within or outside of the processor 102 (e.g., CPU). For example, the current measuring circuitry 104 may convert the AC signal current flow to a digital signal (to produce the current flow detection signal 106, for instance) or the processor 102 may convert the current flow detection signal 106 to a digital signal. By analyzing the current flow values, the circuitry 100 may determine the time that current starts flowing. Analysis of the current flow values may be performed in (e.g., by) the processor 102 (e.g., CPU) or outside of the processor 102 (e.g., in the current measuring circuitry 104).

The relay circuitry 112 may be an electrically operated switch. For example, the relay circuitry 112 may include one or more components for switching (e.g., closing and/or opening an electrical circuit). Examples of the relay circuitry 112 may include electromechanical relays and solid-state relays. For instance, an electromechanical relay may include one or more components such as terminals, an electromagnet, an armature, a spring, a hinge and/or contact(s). A solid-state relay may include one or more thyristors and/or transistors. The relay circuitry 112 may activate (e.g., contacts may close, a channel is opened, etc.) when a relay activation signal 103 indicates activation (e.g., when the relay activation signal 103 is applied to the relay 112).

The processor 102 may be coupled to the voltage zero cross detection circuitry, to the current measuring circuitry 104 and/or to the relay 112. The processor 102 may execute one or more instructions included in memory and/or firmware (for performing one or more of the functions, method steps, etc., described herein, for example). For example, the processor 102 may be coupled to memory, and/or may include memory (e.g., firmware). The processor 102 may control relay 112 activation and/or deactivation. For example, the processor 102 may provide the relay activation signal 103 to the relay 112 in order to activate the relay 112 (e.g., to close the circuit, to apply the AC signal to the load 114, etc.). For example, the processor 102 may activate the relay 112 based on a received input (e.g., a button press, a received signal, etc.) and/or based on a timer. For instance, the processor 102 may control relay 112 activation in accordance with a schedule and/or based on one or more received inputs (e.g., remote control signal, network message, button press, etc.). In some configurations, the circuitry 100 may be included in an automation switch (e.g., home automation switch). Controlling the relay 112 may allow control of when power is applied to a load 114 that is coupled to the automation switch. For example, the automation switch may control when lights are turned on or off in accordance with a schedule.

The processor 102 may be configured to determine a relay time error based on the zero cross time and the current flow start time. The relay time error may be a difference in time between the zero cross time and the current flow start time. For example, the processor 102 may subtract the current flow start time from the zero cross time to determine the relay time error.

In some configurations, the processor 102 may determine the zero cross time based on the zero cross detection signal 110. For example, the processor 102 may determine one or more zero cross times as indicated by the zero cross detection signal 110. For instance, the processor 102 may determine a time when a zero cross step signal (e.g., step up and/or step down) is received, a time between a positive voltage sample and a negative voltage sample (e.g., when a positive voltage sample is followed by a negative voltage sample or when a negative voltage sample is followed by a positive voltage sample), a time of a zero voltage sample and/or a time when a voltage waveform crosses zero voltage, etc. Additionally or alternatively, the processor 102 may receive a zero cross time (e.g., a binary message indicating a zero cross time) from the voltage zero cross detection circuitry 108.

In some configurations, the processor 102 may select a zero cross time from a plurality of zero cross times. For example, the processor 102 select a zero cross time that is closest in time to the current flow start time and/or a zero cross time that can be approximately matched (e.g., synchronized) with the current flow start time. For instance, in a case where a nearest voltage zero cross time precedes the current flow start time but where circuitry performance (and/or causality) would not allow enough delay to be removed to approximately synchronize the current flow start time with the voltage zero cross time, the processor 102 may select a later voltage zero cross time after the current flow start time. This may allow adding a delay to approximately synchronize the current flow start time and the later voltage zero cross time.

In some configurations, the processor 102 may determine the current flow start time based on the current flow detection signal 106. For example, the processor 102 may determine one or more current flow start times as indicated by the current flow detection signal 106. For instance, the processor 102 may determine a time when a current flow step signal (e.g., step up and/or step down) is received, a time when a non-zero current sample follows a zero current sample and/or a time when a current waveform is non-zero following a zero current, etc. Additionally or alternatively, the processor 102 may receive a current flow start time (e.g., a binary message indicating a current flow start time) from the current measuring circuitry 104.

The processor 102 may also be configured to control relay activation signal timing to reduce the relay time error. Relay activation signal timing may involve a relay activation signal time. The relay activation signal time may be a time at which the processor 102 sends the relay activation signal 103 indicating activation of the relay 112. Accordingly, the relay activation signal time may relate to actual relay activation time (e.g., a time when relay 112 contacts close, when a relay 112 channel is opened, etc.). The amount of time between relay activation signal time and relay activation time may be referred to as a relay response time.

A timing delay may be associated with and/or applied to the activation signal time in order to control (e.g., adjust) the activation signal timing. For example, the processor 102 may increase a timing delay to a relay activation signal time, may decrease a timing delay from the relay activation signal time or may maintain activation signal timing (e.g., maintain a timing delay of the activation signal time). In some configurations, an initial timing delay may be predetermined (e.g., estimated based on circuitry 100, processor 102 and/or relay 112 properties).

In order to reduce the relay time error (e.g., reduce relay time error magnitude, lessen the positive or negative distance between the zero cross time and the current flow start time, improve synchronization between the zero cross time and the current flow start time, converge the zero cross time and the current flow start time, etc.), the processor 102 may adjust the relay activation signal timing (e.g., increase or decrease the timing delay). In some configurations, the processor 102 may adjust relay activation signal timing by increasing or decreasing the timing delay by the amount of the relay time error. For example, in a case that the current flow start time is after the zero cross time, the processor 102 may reduce the timing delay (of the relay activation signal time) by the amount of the relay time error. In a case that the current flow start time is before the zero cross time, the processor 102 may increase the timing delay (of the relay activation signal time) by the amount of the relay time error. Adjusting the timing delay may approximately synchronize the current flow start time with the zero cross time for the next switching cycle.

It should be noted that some relay time error may remain on the next switching cycle. In some configurations, one or more aspects of the approaches described herein may be iterated (e.g., repeated) for one or more switching cycles (e.g., for each switching cycle). Continually attempting to reduce relay time error may address changes in the relay (e.g., wear, response time changes, etc.) over time.

In some configurations, the processor 102 may be configured to start (and/or resume) utilizing (e.g., sampling, recording, storing, addressing, etc.) the current flow detection signal 106 and/or the zero cross detection signal 110 upon detection and/or execution of a relay activation instruction (e.g., at the relay activation signal time). For example, a relay activation instruction may be detected when the processor 102 determines that the relay activation signal 103 will be applied to the relay 112 (e.g., when the processor 102 determines to activate the relay 112 based on a schedule, based on a received signal, based on an input, etc.). Additionally or alternatively, a relay activation instruction may be executed when the processor 102 executes an instruction to activate the relay 112 (e.g., to send to the relay activation signal 103).

The processor 102 may discontinue utilizing (e.g., sampling, recording, storing, addressing, etc.) the current flow detection signal 106 once the information for determining the current flow start time is obtained. Additionally or alternatively, the processor 102 may discontinue utilizing (e.g., sampling, recording, storing, addressing, etc.) the zero cross detection signal 110 once the information for determining the relevant zero cross time(s) is obtained. For example, the processor 102 may discontinue utilizing the zero cross detection signal 110 once the information for determining a zero cross time nearest to the current flow start time (to which the current flow start time may be approximately adjusted) and/or for determining two zero cross times immediately neighboring the current flow start time. Starting and/or discontinuing utilizing the current flow detection signal 106 and/or the zero cross detection signal 110 may allow the processor 102 to only operate on relevant information for controlling the relay activation signal timing. This may allow greater processor 102 efficiency and/or reduced processing load.

Figure 2:
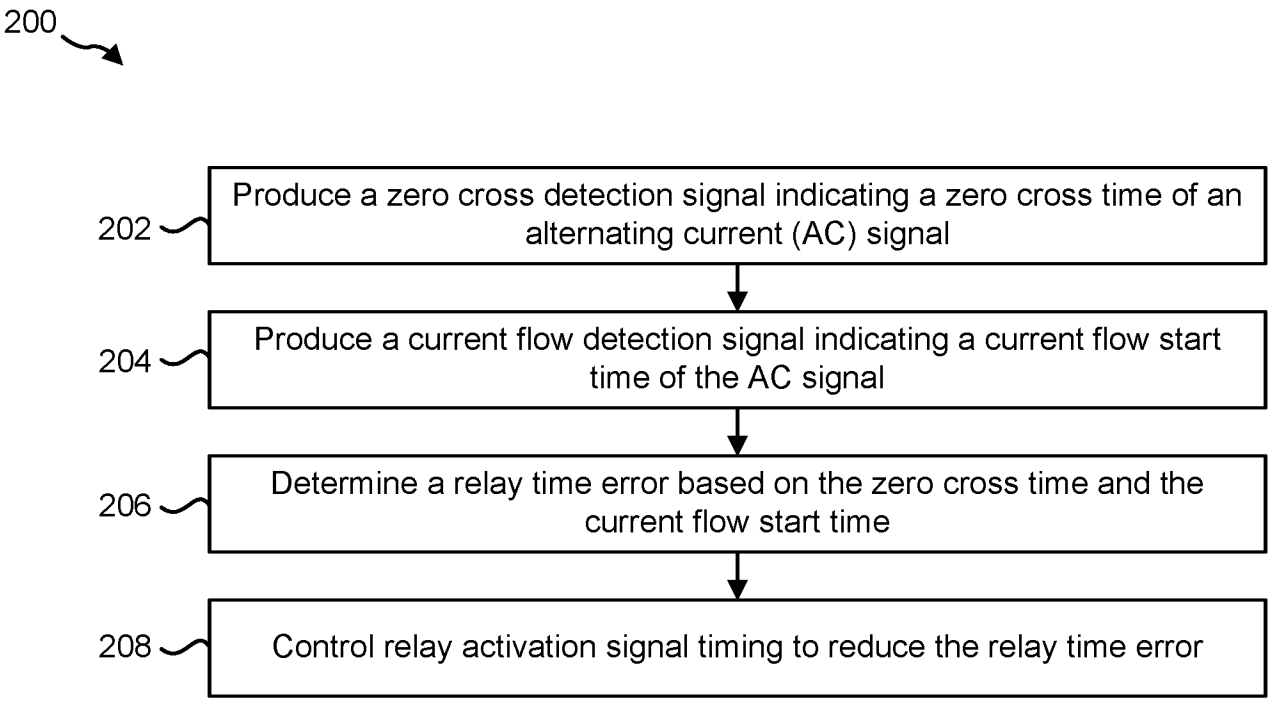
FIG. 2 is a flow diagram illustrating one configuration of a method for controlling relay activation timing.

FIG. 2 is a flow diagram illustrating one configuration of a method 200 for controlling relay activation timing. The method 200 may be performed by the circuitry 100 described in connection with FIG. 1.

The circuitry 100 may produce 202 a zero cross detection signal indicating a zero cross time of an AC signal. This may be accomplished as described in connection with FIG. 1. For example, the zero cross detection circuitry 108 may produce an analog or digital zero cross detection signal (e.g., trigger, pulse, step, waveform, values, etc.) that indicates one or more zero cross times.

The circuitry 100 may produce 204 a current flow detection signal indicating a current flow start time of the AC signal. This may be accomplished as described in connection with FIG. 1. For example, the current measuring circuitry 104 may produce an analog or digital current flow detection signal (e.g., trigger, pulse, step, waveform, values, etc.) that indicates a current flow start time.

The circuitry 100 may determine 206 a relay time error based on the zero cross time and the current flow start time. This may be accomplished as described in connection with FIG. 1. For example, the processor 102 may determine a time difference between the zero cross time and the current flow start time.

The circuitry 100 may control 208 relay activation signal timing to reduce the relay time error. This may be accomplished as described in connection with FIG. 1. For example, the processor 102 may increase or reduce a timing delay for the relay activation signal 103, which may adjust the current flow start time. For instance, the processor 102 may adjust the timing delay to approximately synchronize the current flow start time with the voltage zero cross time. The adjusted timing may be applied for the next switching cycle, for example.

The selection and order of the steps described above is merely one example. In alternative implementations, steps of the method 200 may be modified, omitted, re-ordered, and/or supplanted with additional steps.

Figure 3:
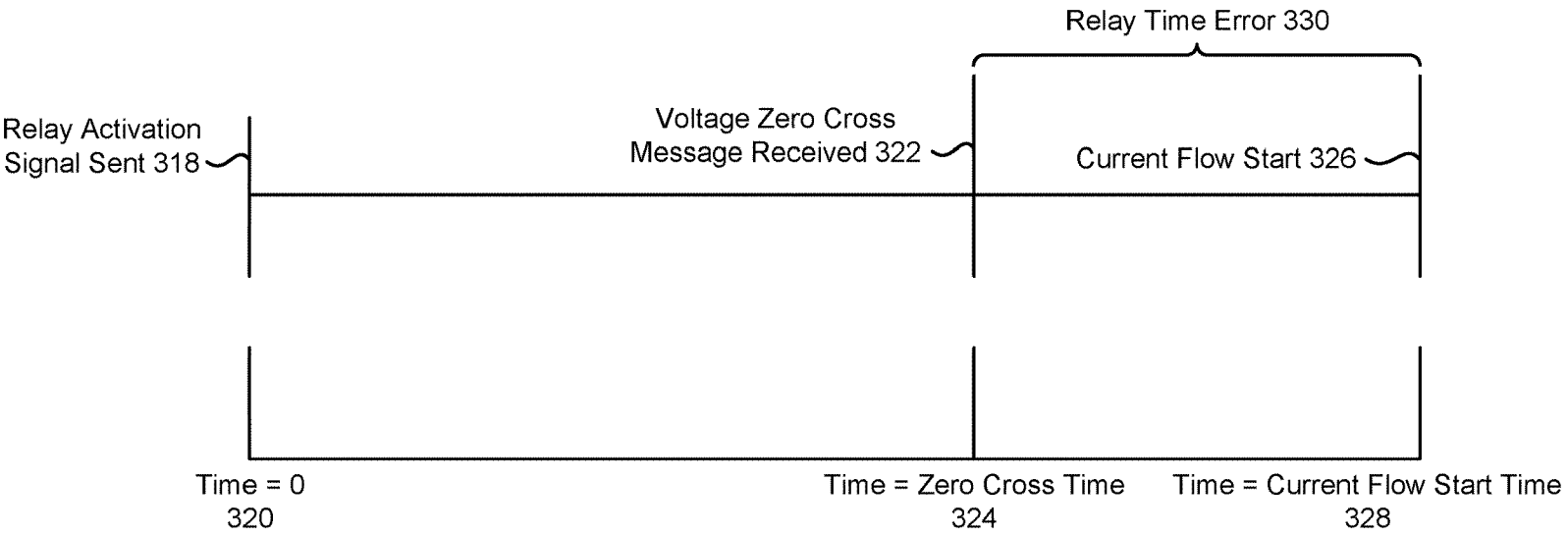
FIG. 3 is a timing diagram illustrating one example of relay time error.

FIG. 3 is a timing diagram illustrating one example of relay time error 330. In particular, FIG. 3 illustrates an example of determining the relay time error 330 in accordance with the systems and methods disclosed herein.

As illustrated in FIG. 3, a relay activation signal may be sent 318 (by the processor 102, for instance) at time zero 320. In this example, a voltage zero cross message is received 322. For instance, the processor 102 may receive 322 a zero cross detection signal 110 (e.g., step signal, trigger signal, etc.) from the voltage zero cross detection circuitry 108. The time at which the zero cross message was received 322 may be determined as zero cross time 324 (by the processor 102, for instance).

As illustrated in FIG. 3, a current flow may start 326. For example, the processor 102 may receive a current flow detection signal 106 that indicates the current flow start 326. The time at which the current flow start 326 occurs by may be determined as the current flow start time 328 (by the processor 102, for instance). The relay time error 330 may be the difference between the current flow start time 328 and the zero cross time 324. For example, the processor 102 may subtract the zero cross time 324 from the current flow start time 328 to determine the relay time error 330. For the next switching cycle, the timing delay for the relay activation signal time may be reduced by the amount of the relay time error 330.

Figure 4:
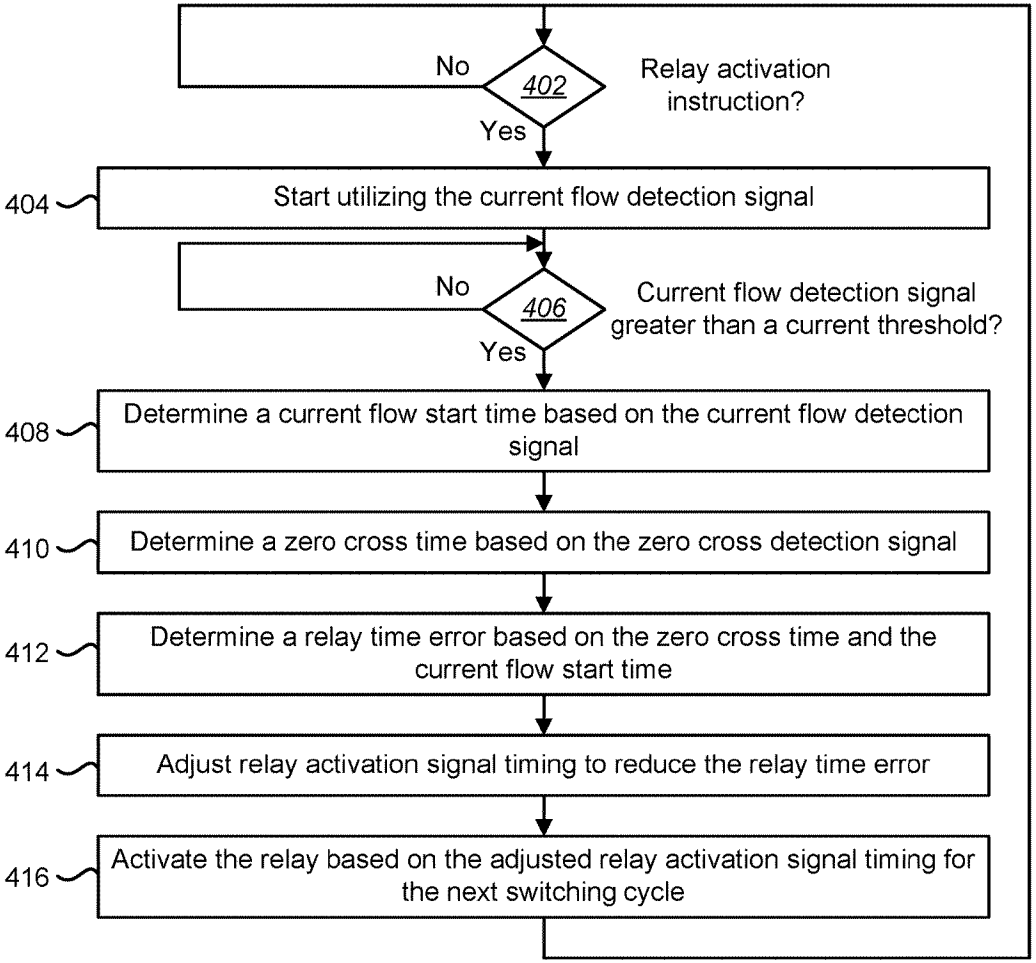
FIG. 4 is a flow diagram illustrating a more specific configuration of a method for controlling relay activation timing.

FIG. 4 is a flow diagram illustrating a more specific configuration of a method 400 for controlling relay activation timing. The method 400 may be performed by the circuitry 100 described in connection with FIG. 1.

The circuitry 100 (e.g., processor 102) may determine 402 whether a relay activation instruction is detected and/or executed. This may be accomplished as described in connection with FIG. 1. For example, the circuitry 100 (e.g., processor 102) may detect and/or execute a relay activation instruction when the processor 102 determines that the relay activation signal 103 will be applied to the relay 112 and/or when the processor 102 executes an instruction to activate the relay 112 (e.g., to send to the relay activation signal 103).

If no relay activation instruction is detected and/or executed, the circuitry 100 may return to determining 402 whether a relay activation instruction is detected and/or executed. For example, the circuitry 100 (e.g., processor 102) may wait to perform one or more steps of the method 400 until a relay activation instruction is detected and/or executed.

If a relay activation instruction is detected and/or executed, the circuitry 100 (e.g., processor 102) may start 404 utilizing the current flow detection signal 106. This may be accomplished as described in connection with FIG. 1. For example, the processor 102 may start sampling, recording, storing, addressing, monitoring, responding to, etc., the current flow detection signal 106. In some configurations, the circuitry 100 may additionally or alternatively start utilizing the zero cross detection signal 110 (e.g., sampling, recording, storing, addressing, responding to, etc.) upon determining 402 that the relay activation instruction is detected and/or executed. In other configurations, the circuitry 100 (e.g., processor 102) may continuously utilize (e.g., sample, record, store, address, monitor, etc.). For example, steps 402 and/or 404 may be optional and/or may not be implemented in some configurations of the systems and methods disclosed herein.

The circuitry 100 (e.g., processor 102) may optionally determine 406 whether a current flow detection signal 106 (e.g., a waveform amplitude, an amplitude value indicated by the current flow detection signal 106, etc.) is greater than one or more current thresholds. This may be accomplished as described in connection with FIG. 1. For example, the circuitry 100 (e.g., processor 102) may determine whether the current flow detection signal 106 indicates a current value (e.g., amplitude, magnitude, etc.) that is greater than one or more predetermined current thresholds. In some configurations, a current threshold may be 0.5 amperes (A), 1 A or another value. The current threshold(s) may represent a current noise threshold and/or a current protection threshold. For example, a current noise threshold may be a value at which AC signal current is unlikely to be just noise. A current protection threshold may be a value at which AC signal current is likely damaging to the relay if the current flow start time is not approximately synchronized with the zero cross time. Depending on the implementation, one or both of the current noise threshold and the current protection threshold may be reached before performing one or more of steps 408, 410, 412, 414 and 416.

If the current flow detection signal 106 is not greater than the current threshold(s), the circuitry 100 may return to determine 406 whether the current flow detection signal is greater than the current threshold(s). For example, the circuitry 100 (e.g., processor 102) may wait to determine 408 the current flow start time until one or more of the current thresholds are met. In some implementations and/or cases, where a current noise threshold is reached, but a higher current protection threshold is not reached, for example, the circuitry 100 (e.g., processor 102) may not analyze and/or adjust relay activation timing (e.g., may skip one or more of steps 408, 410, 412, 414 and 416) and/or may apply the current to a load 114. This may be a case where the load 114 draws a low enough current that does not significantly damage the relay 112.

If the current flow detection signal 106 is greater than the current threshold(s), the circuitry 100 (e.g., processor 102) may determine 408 a current flow start time based on the current flow detection signal 106 (e.g., waveform, digital indicator, digital samples, digital time indicator, etc.). This may be accomplished as described in connection with FIG. 1. For example, the processor 102 may receive the current flow detection signal 106, which may provide a digital indicator (e.g., step signal, pulse, etc.), digital samples (e.g., bits, numbers, etc.), a digital time indicator and/or an analog waveform that indicates when a current flow start in the AC signal has occurred. The processor 102 may determine the time that the digital indicator was received as the current flow start time, the time indicated by the samples (e.g., when a non-zero sample occurs following a zero sample or when the last zero sample before a non-zero sample occurs) as the current flow start time, the time indicated by the digital time indicator as the current flow start time and/or the time indicated by the waveform (e.g., when the waveform increases from zero) as the current flow start time.

In some implementations where current thresholding (e.g., current noise threshold and/or current protection threshold) is utilized, the circuitry 100 (e.g., processor 102 may step back from a time that a current threshold was crossed to determine 408 the current flow start time. For example, the processor 102 may examine the current waveform (e.g., current waveform samples) in reverse order to determine the current flow start time (e.g., a time at which the current was first non-zero or when the current was 0 before the current was non-zero).

The circuitry 100 (e.g., processor 102) may determine 410 a zero cross time based on the zero cross detection signal. This may be accomplished as described in connection with FIG. 1. For example, the processor 102 may receive the zero cross detection signal 110, which may provide a digital indicator (e.g., step signal, pulse, etc.), digital samples (e.g., bits, numbers, etc.), a digital time indicator and/or an analog waveform that indicates when a zero cross in the AC signal has occurred. The processor 102 may determine the time that the digital indicator was received as the zero cross time, the time indicated by the samples (e.g., when a positive sample switches to a negative sample and/or when a zero sample occurs) as the zero cross time, the time indicated by the digital time indicator as the zero cross time and/or the time indicated by the waveform (e.g., when the waveform switches from positive to negative or vice versa) as the zero cross time. It should be noted that the circuitry (e.g., processor) may determine multiple zero cross times and/or select one zero cross time as described in connection with FIG. 1.

The circuitry 100 (e.g., processor 102) may determine 412 a relay time error based on the zero cross time and the current flow start time. This may be accomplished as described in connection with one or more of FIGS. 1-3. For example, the processor 102 may determine a time difference between the zero cross time and the current flow start time.

The circuitry 100 (e.g., processor 102) may adjust 414 relay activation signal timing to reduce the relay time error. This may be accomplished as described in connection with one or more of FIGS. 1-3. For example, the processor 102 may increase or reduce a timing delay for the relay activation signal 103, which may adjust the current flow start time. For instance, the processor 102 may adjust the timing delay to approximately synchronize the current flow start time with the voltage zero cross time.

The circuitry 100 (e.g., processor 102) may activate 416 the relay 112 based on the adjusted relay activation signal timing for the next switching cycle. Activation signal timing to reduce the relay time error. This may be accomplished as described in connection with one or more of FIGS. 1-3. For example, the circuitry 100 (e.g., processor) may activate the relay for the next switching cycle by sending the relay activation signal 103 with the reduced or extended timing delay. It should be noted that the method 400 may include supplying power (e.g., current) to the load 114 for one or more switching cycles corresponding to the relay activation in some implementations.

The selection and order of the steps described above is merely one example. In alternative implementations, steps of the method 400 may be modified, omitted, re-ordered, and/or supplanted with additional steps.

Figure 5:
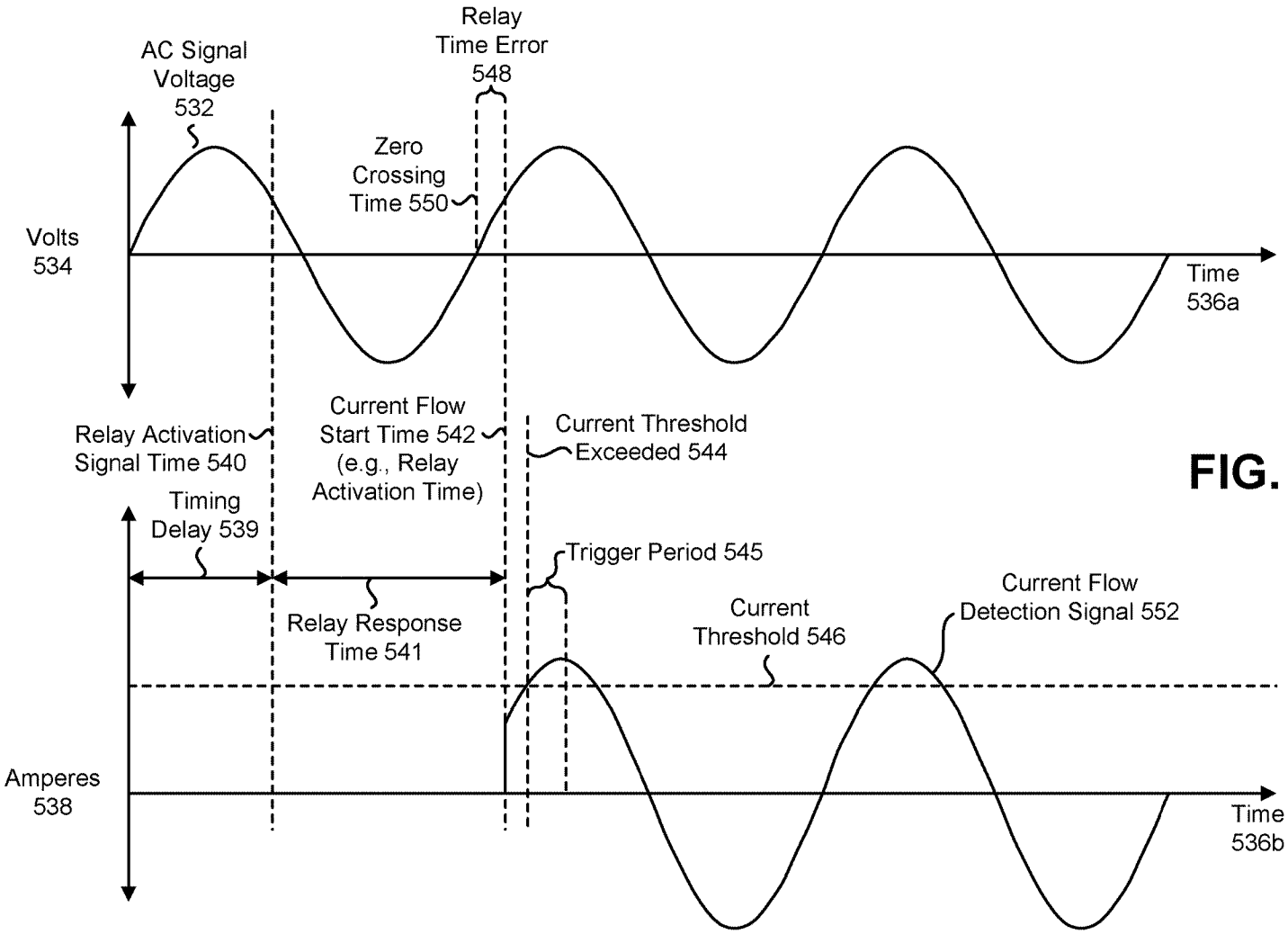
FIG. 5 is a diagram illustrating graphs of an example of alternating current (AC) signal voltage and a current flow detection signal.

FIG. 5 is a diagram illustrating graphs of an example of AC signal voltage 532 and a current flow detection signal 552. Specifically, the upper plot in FIG. 5 illustrates volts (V) 532 over time 536*a* for AC signal voltage 532. The lower plot in FIG. 5 illustrates amperes (A) 538 over time 536*b* for a current flow detection signal 552. In the example illustrated in FIG. 5, it should be noted that the current flow detection signal 552 may represent a real-time current waveform of the AC signal.

As illustrated in FIG. 5, the current flow detection signal 552 is in phase with the AC voltage signal 532, which may occur with a resistive load. In other words, the graphs may depict the results of a relay switching a resistive load where current is in phase with voltage. In some configurations, the AC signal voltage 532 may represent the line voltage and the current flow detection signal 522 may represent the AC signal current measured. It should be noted that in other examples, the current flow detection signal 552 may lag the AC signal voltage (which may occur with an inductive load, for instance) or may lead the AC signal voltage (which may occur with a capacitive load, for instance). It should be noted that relay timing may be managed for the initial activation, which may be adjusted to occur at voltage zero cross. For instance, phase may not matter since current starts flowing once voltage is exposed to the load.

As illustrated in FIG. 5, the circuitry 100 (e.g., processor 102) may employ a timing delay 539 on the relay activation signal time 540. The timing delay 539 may allow for adjustment of the current flow start time 542. In some implementations, an initial timing delay may be predetermined. The timing delay 539 may be an amount of time between when a relay activation instruction is detected and/or executed to the relay activation signal time 540. In some cases, the initial current flowing may have a large spike depending on how close the default relay timing is to the timing delay (e.g., initial timing delay, which may be built into firmware for the circuitry 100 and/or processor 102).

As illustrated in FIG. 5, a relay response time 541 may occur. The relay response time 541 may be the amount of time it takes for the relay 112 to activate from the relay activation signal time 540 (e.g., the time between the relay activation signal time 540 and the actual relay activation time).

As illustrated in FIG. 5, the processor 102 may provide the relay activation signal 103 at the relay activation signal time 540. As described in connection with FIG. 4, the circuitry 100 (e.g., processor 102) may start utilizing (e.g., sampling) the current flow detection signal 552 at the relay activation signal time 540 in some configurations. For example, the current waveform or AC signal current (e.g., current flow detection signal 552) may begin to be continuously measured within a reasonable time after the relay has been commanded on (e.g., after the relay activation signal time 540).

In this example, a zero crossing then occurs. For example, the processor 102 may determine the zero crossing time 550 based on the zero cross detection signal 110. The processor 120 may also determine a current flow start time 542. For instance, the processor 102 may determine the time at which a non-zero current flow detection signal 552 has occurred. In some configurations, the processor 120 may determine the last time of effectively zero current before the non-zero current flow as the current flow start time 542. Alternatively, the processor 120 may determine the time at which a first non-zero current is indicated by the current flow detection signal 552 as the current flow start time 542.

In some configurations, a current threshold 546 (e.g., a current noise threshold and/or a current protection threshold) may be utilized. For example, the processor 102 may determine a time at which the current threshold is exceeded 544. The processor 102 may find the last (e.g., most recent) zero sample of the current flow detection signal 552 from the time the current threshold was exceeded 544. The time of the zero sample or of the first non-zero sample after the zero sample may be determined as the current flow start time 542. For instance, the circuitry 100 (e.g., processor 102) may look for a current level that exceeds a 0.5 Amps current threshold and then count backward until we the current value is dropped to an effectively zero current reading. That point may then be utilized as the current flow start time 542. In some configurations, the absolute value of the current flow detection signal 552 may be utilized in determining the current flow start time, since magnitude may indicate flow (whereas specific polarity may not be needed, for example). In one specific example, the relay response time 541 may be 4.5 milliseconds (ms) including 3 ms between the relay activation signal time 540 and the zero crossing time 550 in addition to a relay time error 548 of 1.5 ms.

In some configurations, a trigger period 545 may be utilized. For example, the trigger period 545 may be a time period where the current flow detection signal 552 must be above the current threshold in order to trigger current flow start time 542 determination. This approach may help to filter noise (e.g., avoid using noise spikes to trigger current flow start time).

As illustrated in FIG. 5, the circuitry 100 (e.g., processor 102) may determine the relay time error 548 as the difference between the current flow start time 542 and the relay zero crossing 550 (e.g., the nearest zero crossing). It should be noted that the current flow start time may occur before the zero crossing time in some cases.

For the next switching cycle, the circuitry 100 (e.g., processor 102) may adjust the timing delay 539. For example, the processor 102 may subtract the relay time error 548 from the timing delay 539 to approximately synchronize the current flow start time and the zero crossing time.

Figure 6:
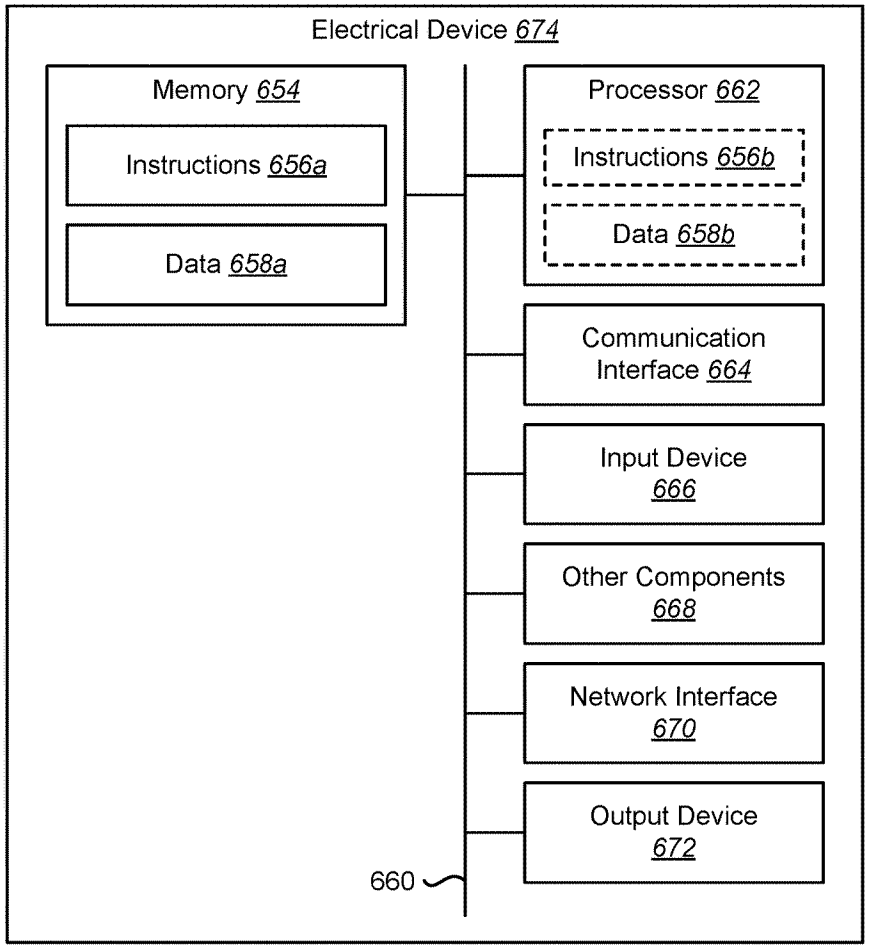
FIG. 6 is a block diagram illustrating various components that may be utilized in an electrical device.

FIG. 6 is a block diagram illustrating various components that may be utilized in an electrical device 674. One or more of the devices described herein may be implemented in accordance with the electrical device 674 described in connection with FIG. 6. In some configurations, the electrical device 674 may be implemented in accordance with the circuitry 100 described in connection with FIG. 1. For example, the electrical device 674 may be configured to perform the one or more of the methods 200, 400 described above. An electrical device 674 may include the broad range of circuitries, electronic devices, etc. Examples of electrical devices 674 may include switches, power outlets, lights, light fixtures, appliances (e.g., clothes washers, clothes dryers, dishwashers, refrigerators, ovens, toasters, etc.), televisions, entertainment systems, sound systems (e.g., stereos), game consoles, computers, computing devices, security systems, home automation systems, etc. In some configurations, the electrical device 674 may be an embedded device inside an otherwise complete device (e.g., within an appliance).

The electrical device 674 is shown with a processor 662 and memory 654. The processor 662 may control the operation of the electrical device 674 and may be embodied as a microprocessor, a microcontroller, a digital signal processor (DSP) or other device known in the art. The processor 662 typically performs logical and arithmetic operations based on program instructions 656*a* and/or data 658*a* stored within the memory 654. The instructions 656*a* in the memory 654 may be executable to implement the methods described herein. FIG. 6 illustrates instructions 656*b* and/or data 658*b* being loaded onto the processor 662. The instructions 656*b* and/or data 658*b* may be the instructions 656*a* and/or data 658*a* (or portions thereof) stored in memory 654.

The electrical device 674 may also include one or more communication interfaces 664 and/or network interfaces 670 for communicating with other computing and/or electronic devices. The communication interface(s) 664 and the network interface(s) 670 may be based on wired communication technology, and/or wireless communication technology, such as ZigBee®, WiMax®, WiFi®, Bluetooth® and/or cellular protocols, such as GSM®, etc.

The electrical device 674 may also include one or more input devices 666 and one or more output devices 672. The input devices 666 and output devices 672 may facilitate user input/user output. Other components 668 may also be provided as part of the electrical device 674.

Instructions 656*a* and data 658*a* may be stored in the memory 654. The processor 662 may load and execute instructions 656*b* from the instructions 656*a* in memory 654 to implement various functions. Executing the instructions 656*a* may involve the use of the data 658*a* that is stored in the memory 654. The instructions 656*b* and/or data 658*b* may be loaded onto the processor 662. The instructions 656 may be executable to implement one or more of the methods described herein, and the data 658 may include one or more of the various pieces of data described herein.

The memory 654 may be any electronic component capable of storing electronic information. The memory 654 may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM), an ASIC (Application Specific Integrated Circuit), registers, and so forth, including combinations thereof. The various components of the electrical device 674 may be coupled together by a bus system 660, which may include a power bus, a control signal bus and a status signal bus, in addition to a data bus. However, for the sake of clarity, the various buses are illustrated in FIG. 6 as the bus system 660.

In the above description, reference numbers have sometimes been used in connection with various terms. Where a term is used in connection with a reference number, it may refer to a specific element that is shown in one or more of the Figures. Where a term is used without a reference number, it may refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The term "processor" should be interpreted broadly to encompass a general purpose processor, a central processing unit (CPU), a microprocessor, a digital signal processor (DSP), a controller, a microcontroller, a state machine, and so forth. Under some circumstances, a "processor" may refer to an application specific integrated circuit (ASIC), a programmable logic device (PLD), a field programmable gate array (FPGA), etc. The term "processor" may refer to a combination of processing devices e.g., a combination of a DSP and a microprocessor, a plurality of microprocessors, one or more microprocessors in conjunction with a DSP core, or any other such configuration.

The term "memory" should be interpreted broadly to encompass any electronic component capable of storing electronic information. The term memory may refer to various types of processor-readable media such as random access memory (RAM), read-only memory (ROM), non-volatile random access memory (NVRAM), programmable read-only memory (PROM), erasable programmable read only memory (EPROM), electrically erasable PROM (EEPROM), flash memory, magnetic or optical data storage, registers, etc. Memory is said to be in electronic communication with a processor if the processor can read information from and/or write information to the memory. Memory that is integral to a processor is in electronic communication with the processor.

The terms "instructions" and "code" should be interpreted broadly to include any type of computer-readable or processor-readable statement(s). For example, the terms "instructions" and "code" may refer to one or more programs, routines, sub-routines, functions, procedures, etc. "Instructions" and "code" may comprise a single computer-readable statement or many computer-readable statements.

The term "computer-readable medium" refers to any available medium that can be accessed by a computer or processor. By way of example, and not limitation, a computer-readable medium may comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. A computer-readable medium may be tangible and non-transitory. Disk and disc, as used herein, includes compact disc (CD), laser disc, optical disc, digital versatile disc (DVD), floppy disk and Blu-Ray® disc where disks usually reproduce data magnetically, while discs reproduce data optically with lasers.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods and apparatus described herein without departing from the scope of the claims.

What is claimed is:

1. Circuitry for controlling relay activation timing, comprising:

voltage zero cross detection circuitry configured to produce a zero cross detection signal indicating a zero cross time of an alternating current (AC) signal;

current measuring circuitry coupled to the voltage zero cross detection circuitry, wherein the current measuring circuitry is configured to produce a current flow detection signal indicating a current flow start time associated with the AC signal;

relay circuitry coupled to the current measuring circuitry; and a processor coupled to the voltage zero cross detection circuitry, to the current measuring circuitry, and to the relay circuitry, wherein the processor is configured to determine whether the current flow detection signal is greater than a current threshold and to determine a relay time error based on the zero cross time and the current flow start time, and wherein the processor is configured to control relay activation signal timing to reduce the relay time error.

2. The circuitry of claim 1, wherein the processor is configured to determine the relay time error as a time difference between the current flow start time and the zero cross time.

3. The circuitry of claim 1, wherein the processor is configured to adjust the activation signal timing by increasing or decreasing a timing delay by an amount of the relay time error.

4. The circuitry of claim 1, wherein the processor is configured to activate the relay circuitry based on adjusted relay activation signal timing for a next switching cycle.

5. The circuitry of claim 1, wherein the processor is configured to start utilizing the current flow detection signal upon detection of a relay activation instruction.

6. The circuitry of claim 1, wherein the processor is configured to determine the current flow start time by stepping back from a time at which the current flow detection signal crossed the current threshold.

7. The circuitry of claim 1, wherein the current measuring circuitry is coupled between an alternating current supply and an input to the relay circuitry.

8. The circuitry of claim 1, wherein the voltage zero cross detection circuitry is coupled between an alternating current supply and the processor.

9. A method for controlling relay activation timing, comprising:

producing a zero cross detection signal indicating a zero cross time of an alternating current (AC) signal;

producing a current flow detection signal indicating a current flow start time associated with the AC signal;

determining whether the current flow detection signal is greater than a current threshold;

determining a relay time error based on the zero cross time and the current flow start time; and controlling relay activation signal timing to reduce the relay time error.

10. The method of claim 9, further comprising determining the relay time error as a time difference between the current flow start time and the zero cross time.

11. The method of claim 9, wherein controlling the relay activation signal timing comprises adjusting the activation signal timing by increasing or decreasing a timing delay by an amount of the relay time error.

12. The method of claim 9, further comprising activating a relay based on adjusted relay activation signal timing for a next switching cycle.

13. The method of claim 9, further comprising starting to utilize the current flow detection signal upon detection of a relay activation instruction.

14. The method of claim 9, wherein determining the current flow start time comprises stepping back from a time at which the current flow detection signal crossed the current threshold.

15. A non-transitory tangible computer-readable medium for controlling relay activation timing, the computer-readable medium comprising executable instructions for:

determining whether a current flow detection signal is greater than a current threshold;

determining a relay time error based on a zero cross time and a current flow start time; and controlling relay activation signal timing to reduce the relay time error.

16. The computer-readable medium of claim 15, further comprising executable instructions for determining the relay time error as a time difference between the current flow start time and the zero cross time.

17. The computer-readable medium of claim 15, further comprising executable instructions for adjusting the activation signal timing by increasing or decreasing a timing delay by an amount of the relay time error.

18. The computer-readable medium of claim 15, further comprising executable instructions for activating a relay based on adjusted relay activation signal timing for a next switching cycle.

* * * * *